US006709093B2

(12) United States Patent
Perkins et al.

(10) Patent No.: US 6,709,093 B2
(45) Date of Patent: Mar. 23, 2004

(54) INK CARTRIDGE IN WHICH INK SUPPLY BAG HELD FAST TO HOUSING

(75) Inventors: Mark D. Perkins, Wayland, NY (US); Kenneth D. Corby, Rochester, NY (US); Steven J. Dietl, Ontario, NY (US); Diana C. Petranek, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/215,334

(22) Filed: Aug. 8, 2002

(65) Prior Publication Data

US 2004/0027431 A1 Feb. 12, 2004

(51) Int. Cl.[7] ..... B41J 2/175
(52) U.S. Cl. ..... 347/86
(58) Field of Search ..... 347/84–87

(56) References Cited

U.S. PATENT DOCUMENTS

| | | | | |
|---|---|---|---|---|
| 4,183,031 A | | 1/1980 | Kyser et al. | |
| 4,506,276 A | | 3/1985 | Kyser et al. | |
| 4,853,708 A | | 8/1989 | Walters | |
| 4,907,019 A | | 3/1990 | Stephens | |
| 4,961,088 A | | 10/1990 | Gilliland et al. | |
| 5,138,344 A | | 8/1992 | Ujita | |
| D341,157 S | | 11/1993 | Kitahara et al. | |
| 5,266,968 A | | 11/1993 | Stephenson | |
| 5,293,913 A | | 3/1994 | Preszler | |
| 5,307,091 A | * | 4/1994 | DeCoste, Jr. | 347/86 |
| 5,406,320 A | | 4/1995 | Durst et al. | |
| 5,408,746 A | | 4/1995 | Thoman et al. | |
| 5,410,641 A | | 4/1995 | Wakabayashi et al. | |
| 5,506,611 A | | 4/1996 | Ujita et al. | |
| 5,519,422 A | | 5/1996 | Thoman et al. | |
| 5,530,531 A | | 6/1996 | Girard | |
| 5,552,816 A | | 9/1996 | Oda et al. | |
| 5,561,450 A | | 10/1996 | Brewster, Jr. et al. | |
| 5,610,635 A | | 3/1997 | Murray et al. | |
| 5,666,146 A | | 9/1997 | Mochizuki et al. | |
| 5,691,753 A | | 11/1997 | Hilton | |
| 5,710,579 A | | 1/1998 | Hahs et al. | |
| 5,721,576 A | | 2/1998 | Barinaga | |
| 5,745,137 A | | 4/1998 | Scheffelin et al. | |
| 5,751,322 A | | 5/1998 | Miller et al. | |
| 5,788,388 A | | 8/1998 | Cowger et al. | |
| 5,825,387 A | | 10/1998 | Cowger et al. | |
| 5,825,388 A | | 10/1998 | Sasaki | |
| 5,835,817 A | | 11/1998 | Bullock et al. | |
| 5,860,363 A | | 1/1999 | Childers et al. | |
| 5,880,764 A | | 3/1999 | Barinaga | |
| 5,920,333 A | | 7/1999 | Bates | |

(List continued on next page.)

FOREIGN PATENT DOCUMENTS

| | | |
|---|---|---|
| DE | 3405164 A1 | 8/1985 |
| JP | 359-214656 | 12/1984 |
| JP | 363-004953 | 1/1988 |

*Primary Examiner*—Russell Adams
*Assistant Examiner*—An H. Do
(74) *Attorney, Agent, or Firm*—Roger A. Fields

(57) ABSTRACT

An ink cartridge includes an ink supply bag, a fitting attached to the bag and including an integral ink egress snout, and a pair of housing halves that contain the bag and at respective wall portions have opening halves that form a bottom opening for the snout when the housing halves are connected together. The fitting and only one of the wall portions each have mutually engageable members that engage to connect the fitting and the one wall portion to secure the bag within the housing half that includes the one wall portion. The housing half that includes another of the wall portions has stakes that are adhered to the engageable members of the fitting and/or the engageable members of the housing half that includes the one wall portion.

14 Claims, 5 Drawing Sheets

U.S. PATENT DOCUMENTS 5,956,057 A 9/1999 Childers et al.
5,959,647 A 9/1999 Claramunt et al.
6,000,773 A 12/1999 Murray et al.
6,003,984 A * 12/1999 Bohorquez et al. ..... 347/86
6,003,985 A 12/1999 Bekki
6,019,449 A 2/2000 Bullock et al.
6,053,606 A * 4/2000 Yamaguchi et al. ..... 347/86
6,059,403 A 5/2000 Burgin
6,065,826 A 5/2000 Robinson et al.
6,102,533 A 8/2000 Nozawa et al.
6,130,695 A 10/2000 Childers et al.
6,151,039 A 11/2000 Hmelar et al.
6,155,678 A 12/2000 Komplin et al.
6,164,743 A 12/2000 Hmelar et al.
6,168,262 B1 1/2001 Clark et al.
6,183,077 B1 * 2/2001 Hmelar et al. ..... 347/86
6,199,973 B1 3/2001 Bartolome et al.
6,199,977 B1 3/2001 Komplin et al.
6,203,147 B1 3/2001 Battey et al.
6,209,996 B1 4/2001 Gasvoda et al.
6,227,638 B1 5/2001 Childers et al.
6,227,643 B1 5/2001 Purcell et al.
6,227,663 B1 5/2001 Santhanam et al.
6,243,116 B1 6/2001 Kotaki et al.

* cited by examiner

INK CARTRIDGE IN WHICH INK SUPPLY BAG HELD FAST TO HOUSING

CROSS REFERENCE TO RELATED APPLICATIONS

Reference is made to commonly assigned, U.S. Pat. No. 6,554,402, entitled INK CARTRIDGE WITH COLOR DISCRIMINATION STRUCTURE and filed Aug. 16, 2001 in the names of Trafton, Newkirk, and Robinson; U.S. Pat. No. 6,416,166, entitled INK CARTRIDGE WITH ALIGNMENT FEATURES AND METHOD OF INSERTING CARTRIDGE INTO A PRINTER RECEPTACLE and filed Aug. 16, 2001 in the names of Trafton, Newkirk, Robinson, and Gotham; U.S. Pat. No. 6,505,926, entitled INK CARTRIDGE WITH MEMORY CHIP AND METHOD OF ASSEMBLING and filed Aug. 16, 2001 in the names of Trafton, Newkirk, and Robinson; and U.S. Pat. No. 6,536,888, entitled INK CARTRIDGE WITH INTERNAL INK BAG AND METHOD OF FILLING and filed Aug. 16, 2001 in the names of Trafton, Famung, and Petranek.

Reference is also made to commonly assigned, applications Ser. No. 10/198,517, entitled INK CARTRIDGE HAVING CONNECTABLE-DISCONNECTABLE HOUSING AND INK SUPPLY BAG and filed Jul. 18, 2002 in the names of Perkins, Corby, Dietl, and Petranek, and Ser. No. 10/198,515, entitled DISPOSABLE INK SUPPLY BAG HAVING CONNECTOR-FITTING and filed Jul. 18, 2002 in the names of Perkins, Corby, Dietl, and Petranek.

All of the cross-referenced applications are incorporated into this application.

FIELD OF THE INVENTION

The invention relates generally to ink cartridges for ink jet printers, and in particular to an ink cartridge that has a connectable housing and ink supply bag.

BACKGROUND OF THE INVENTION

The cross-referenced applications filed Aug. 16, 2001 disclose an ink cartridge that has a connectable-disconnectable housing and ink supply bag.

The disclosed cartridge includes an ink bag containing an ink supply, an ink egress snout attached to the ink bag and from which the ink supply is discharged from the ink bag, and a split collar that receives or mates with the snout via an annular rib on the collar and an annular groove on the snout. The collar when mated with the snout can be rotated about the snout to any one of a number of allowable orientations. The particular orientation of the collar that is selected serves to identify the ink supply in the ink bag.

A pair of housing halves for the ink bag when connected together form a bottom opening for the collar. The bottom opening is bounded by multi-sided edges of the housing halves. The collar has a peripheral recess with a multi-sided floor that complements the multi-sided edges. This permits the collar when arranged in any one of the orientations to be trapped in the bottom opening to prevent rotation of the collar relative to the snout. Moreover, it serves to secure the bag to the housing halves.

SUMMARY OF THE INVENTION

According to one aspect of the invention, an ink cartridge comprising an ink supply bag, a housing for the bag, and a fitting attached to the bag and including an ink egress snout for discharging an ink supply from the bag, is characterized in that:

the housing and the fitting are connected to secure the bag within the housing, but can be disconnected; and the housing has stakes that are adhered to the fitting to hold the fitting fast to the housing in order to prevent the fitting from being disconnected from the housing.

According to another aspect of the invention, an ink cartridge comprising an ink supply bag, a fitting attached to the bag and including an integral ink egress snout, and a pair of housing halves that contain the bag and at respective wall portions have opening halves that form a bottom opening for the snout when the housing halves are connected together, is characterized in that:

the fitting and only one of the wall portions each have mutually engageable members that engage to connect the fitting and the one wall portion to secure the bag within the housing half that includes the one wall portion; and the housing half that includes another of the wall portions has stakes that are adhered to the engageable members of the fitting and/or the engageable members of the housing half that includes the one wall portion.

According to another aspect of the invention, a method of partially assembling a ink cartridge including an ink supply bag, a housing that is to contain the bag, and a fitting for the bag which has an ink egress snout for discharging an ink supply from the bag, comprises:

attaching the fitting to the bag;

connecting the housing and the fitting to one another; and adhering to the fitting a plurality of stakes that project from the housing to hold the fitting fast to the housing.

DETAILED DESCRIPTION OF THE INVENTION

Figure 1:
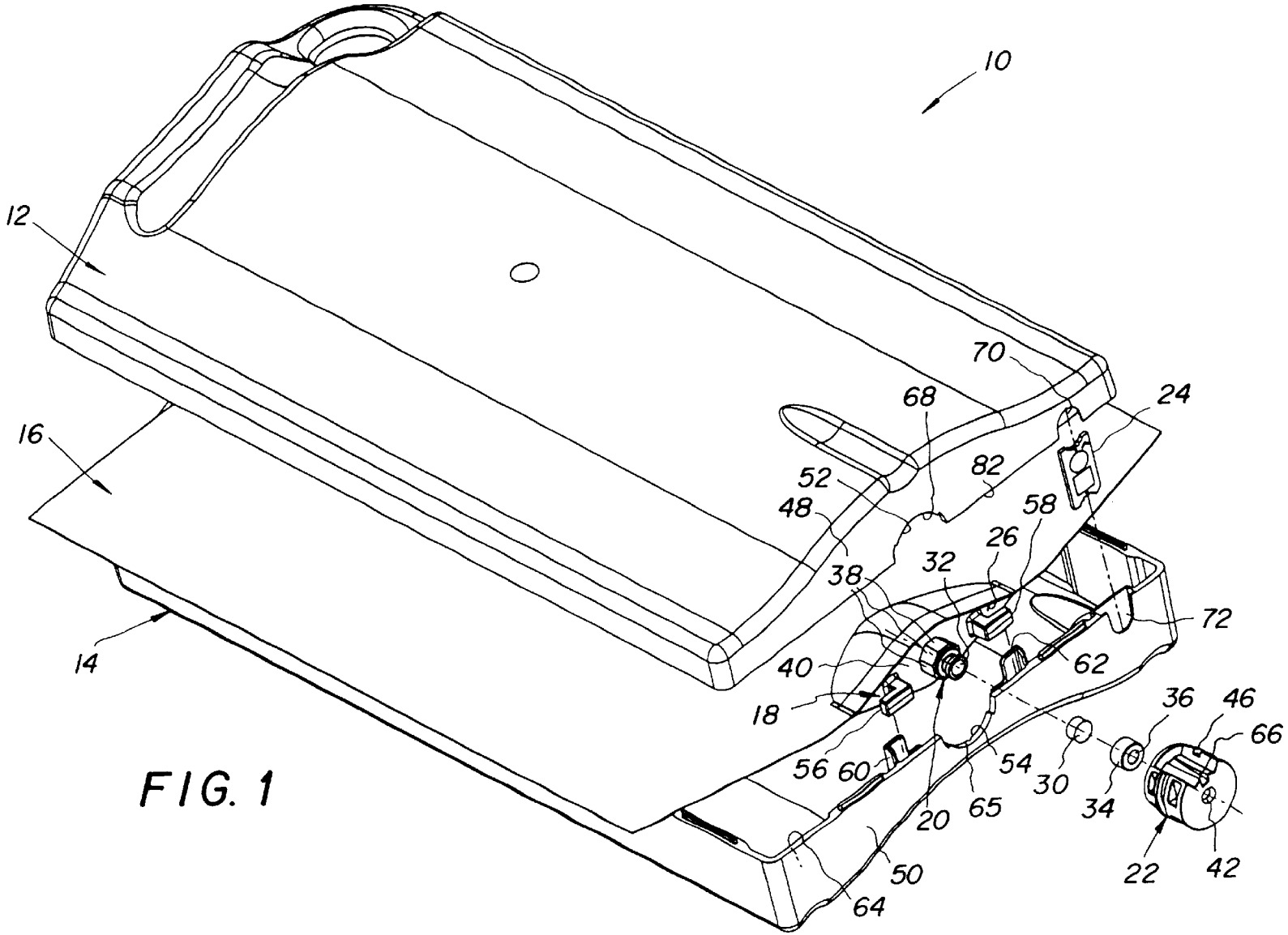
FIG. 1 is an exploded perspective view of an ink cartridge including an ink supply bag, a housing for the bag, and a fitting attached to the bag and which has an ink egress snout for discharging an ink supply from the bag, according to a preferred embodiment of the invention.

Referring now to the drawings, FIGS. 1–7 show an ink cartridge 10 for an ink jet printer (not shown). The cartridge includes the following components:

a pair of plastic housing halves 12 and 14 that mate or connect to form a cartridge housing;

a disposable flexible ink supply bag 16;

a plastic connector-fitting or fitment 18 having an integral ink egress snout 20 for discharging an ink supply from the bag 16;

a plastic single-part collar 22 for the snout 20, which functions as an ink identifier to identify the ink supply in the bag 16 such as by color or type; and a memory chip 24.

Figure 3:
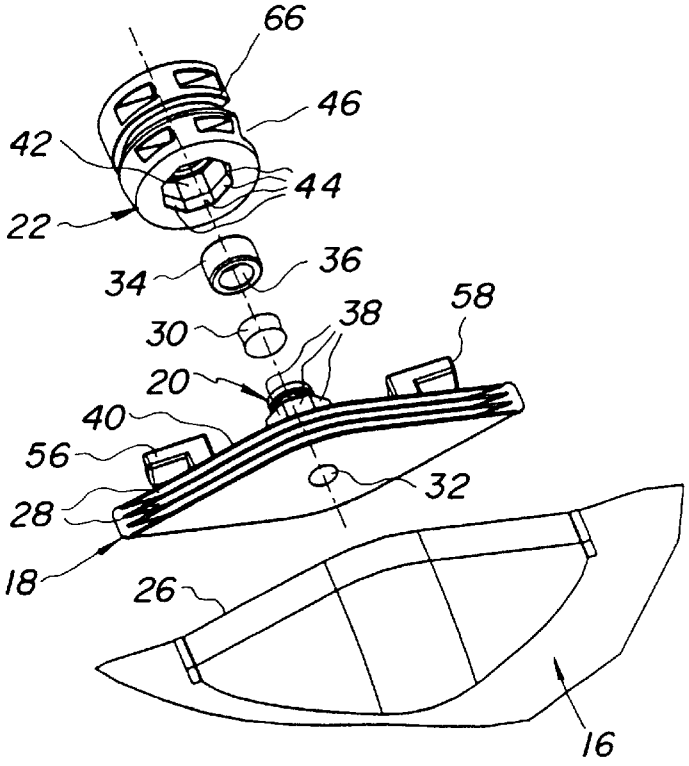
FIGS. 2 and 3 are exploded perspective views of the ink supply bag, the ink egress snout, and the fitting, as shown from opposite views.
Figure 2:
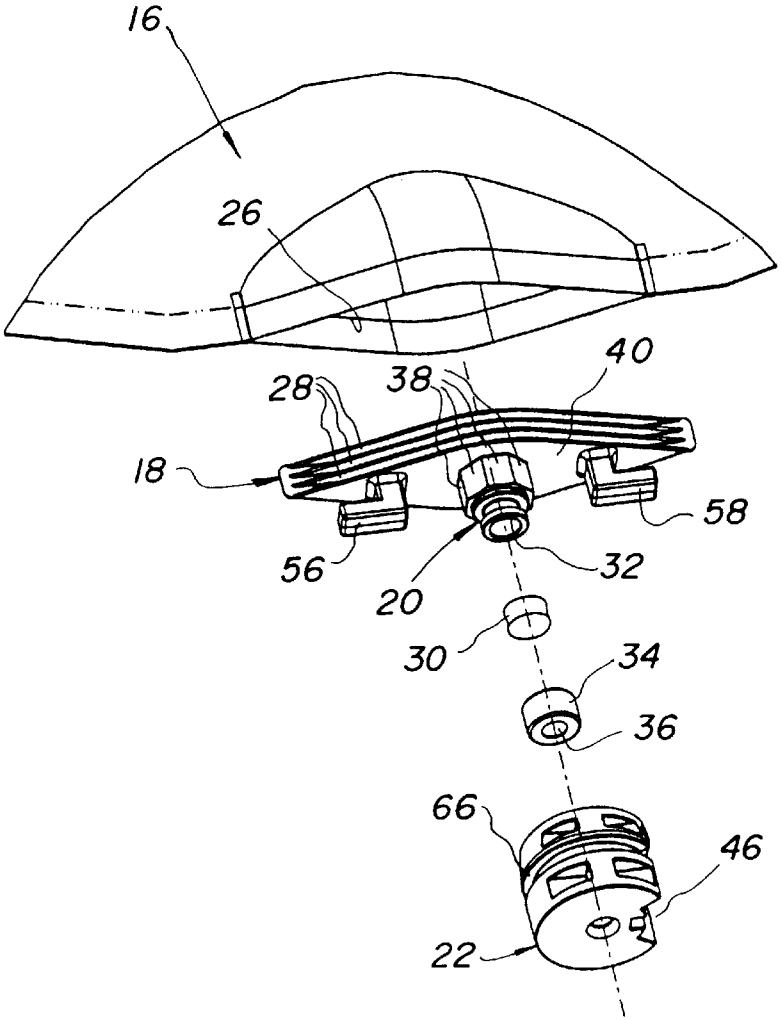

As shown in FIGS. 2 and 3, the fitting 18 is attached via a thermal seal to the bag 16, within an elongate opening 26 in the bag. During the thermal seal of the bag 16 to the fitting 18, a small amount of melted material from the bag flows to between parallel ribs 28 along opposite longitudinal sides of the fitting 18 to provide an essentially leak-proof seal between the bag and the fitting. A rubber septum 30 is tightly inserted into an ink egress opening 32 in the snout 20 to plug the opening. Then, an aluminum or stainless steel cap 34 is press-fitted on the snout 20. The cap 34 partially overlaps the septum 30 to capture the septum, and has a center opening 36 which allows a hollow needle (not shown) to pierce the septum in order to discharge an ink supply from the bag 16 when the cartridge 10 is used in an ink jet printer.

Collar 22 And Snout 20

The snout 20 has eight identical outer peripheral surfaces (sides) or facets 38 that project perpendicular from a longitudinal planar face 40 of the fitting 18 to form an octagon. See FIGS. 2 and 3. In a similar sense, the collar 22 has a center opening 42 that is circumscribed by eight identical inner peripheral surfaces (sides) or facets 44 that form an octagon. This mutual or complementary configuration allows the snout 20 to be received in the center opening 42 only when the collar 22 is in any one of eight allowable angular orientations 0° or 360°, 45°, 90°, 135°, 180°, 225°, 270°, and 315°. Preferably, the eight surfaces 44 of the collar 22 are aligned with the eight surfaces 38 of the snout 20 to position the collar relative to the snout in a selected one of the eight orientations. Then, the collar 22 is mated with the snout 20 in the selected orientation. Respective contact between the eight surfaces 38 and the eight surfaces 44 prevents the collar 22 from being rotated about the snout 22 and thus serves to fix the collar in the selected orientation. The selected orientation provides a visible indication that serves to identify the ink supply in the bag 16 such as by color or type.

As described in the cross-referenced applications filed Aug. 16, 2001 and incorporated into this application, the collar 22 has a key slot or keyway 46 that is angular positioned in accordance with the selected orientation of the collar. The hollow needle (not shown) for piercing the septum in order to discharge an ink supply from the bag 16 when the cartridge 10 is used in an ink jet printer is mounted on a key assembly (not shown) having a key tab intended to be received in the key slot 46. The particular orientation of the key assembly must match the selected orientation of the collar 22 in order for the key tab to be received in the key slot 46.

The number of the surfaces 38 of the snout 20 and the number of the surfaces 44 of the collar 22, need not each be eight (although they must be the same number). Preferably, the number of the surfaces 38 of the snout 20 and the number of the surfaces 44 of the collar 22 fall within the range 4–12. All that is necessary is that the number of the surfaces 38 of the snout 20 and the number of the surfaces 44 of the collar 22 form similar complementary polygons that permit the collar 22 to mate with the snout 20.

L-Shaped Engageable-Disengageable Members 56, 58, 60, 62

Figure 4:
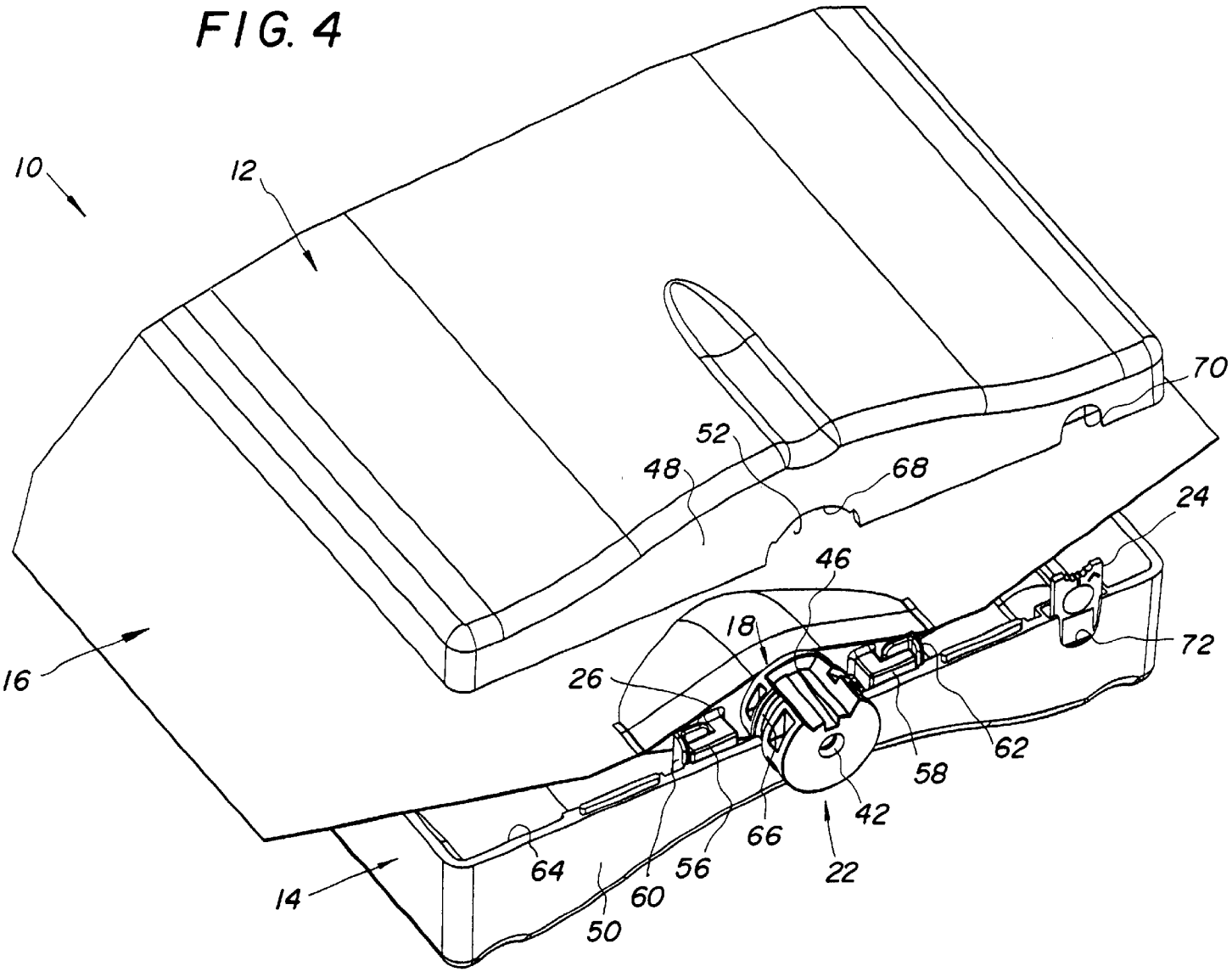
FIG.4 is an enlargement of a bottom portion of the ink cartridge as shown in FIG. 1.
Figure 6:
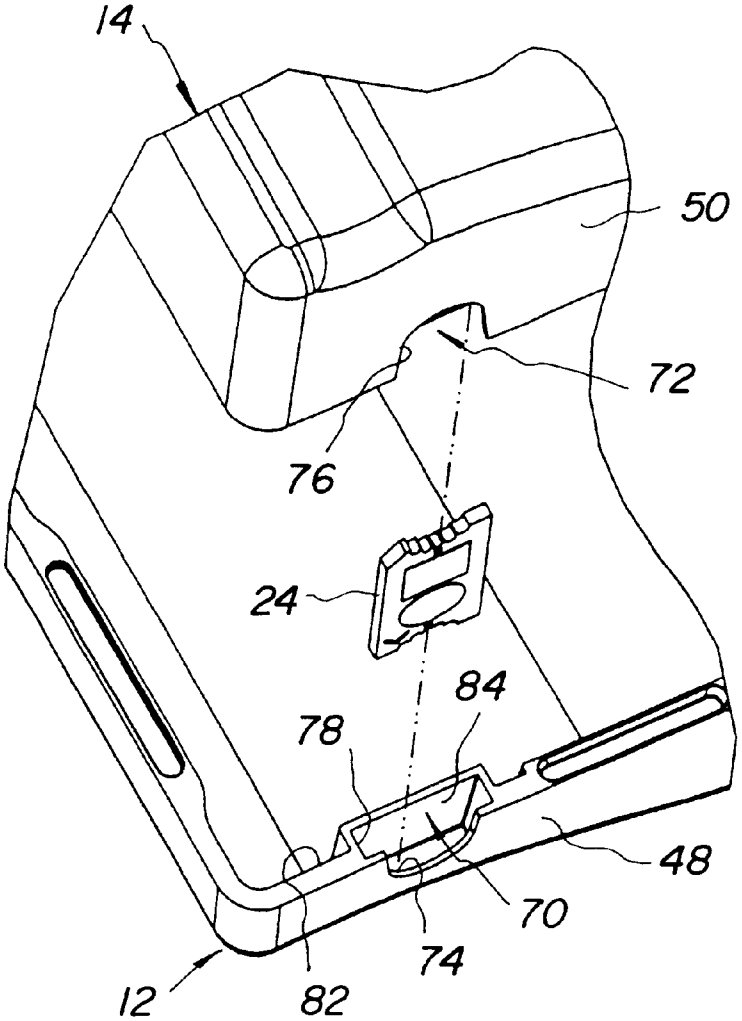
FIGS. 5 and 6 are exploded perspective views of a memory chip as it is inserted into a pocket in the ink jet cartridge.
Figure 5:
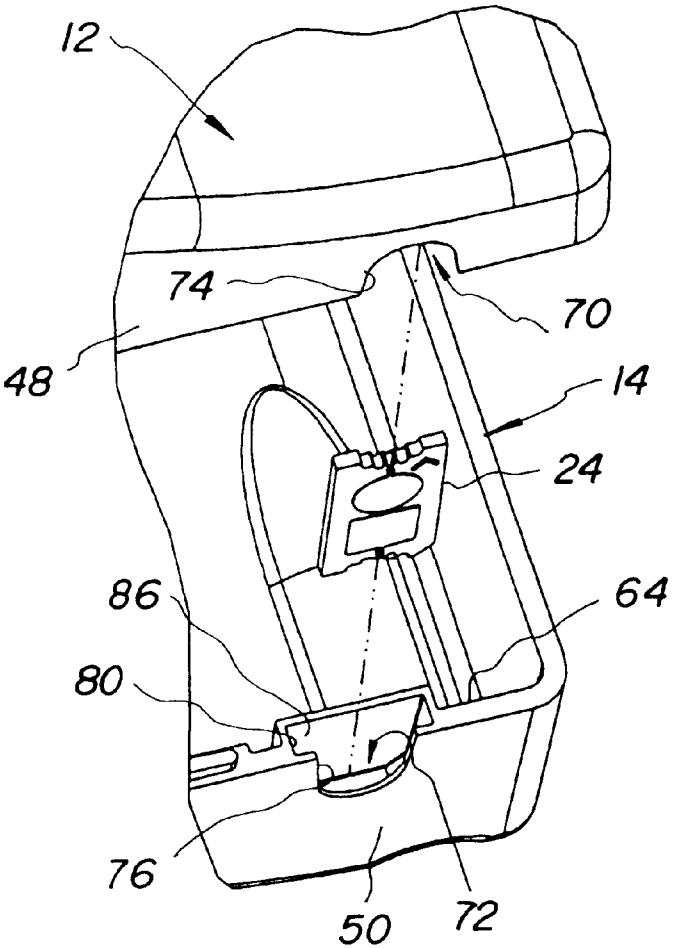

The housing halves 12 and 14 at respective bottom wall portions 48 and 50 have opening halves 52 and 54 that form a single bottom opening when the housing halves are connected together. See FIGS. 1 and 4. The fitting 18 has a pair of L-shaped engageable-disenageable members or tabs 56 and 58 that project from respective areas of the face 40 (of the fitting) which are spaced from the snout 20. In a similar sense, a pair of L-shaped engageable-disengageable members or tabs 60 and 62 project from an inner side 64 of the wall portion 50 and are spaced from the opening half 52. The L-shaped engageable-disengageable members 56 and 58 extend in opposite directions as do the L-shaped engageable-disengageable members 60 and 62. This complementary arrangement or mutual configuration permits the L-shaped member 56 to engage the L-shaped member 60 and the L-shaped member 58 to engage the L-shaped member 62 when the bag 16 is placed on the housing half 14. The bag 16 is thus secured in place. At the same time as shown in FIG. 4 an edge 65 of the opening half 54 is received in an outer peripheral groove 66 in the collar 22 to support the collar. Then, when the housing half 12 is connected to the housing half 14, an edge 68 of the opening half 52 is received in the groove 66.

When the bag 16 is emptied, it is possible to remove the bag (with the fitting 18) from the cartridge 10. If the housing half 12 is disconnected from the housing half 14, the L-shaped engageable-disengageable members 56 and 58 are disengaged from the L-shaped engageable-disengageable members 60 and 62. Also, the collar 22 can be removed from the snout 20.

Other L-shaped engageable-disengageable members can be provided on the fitting 18 and the housing half 14 in addition to the L-shaped engageable-disengageable members 56 and 58 and the L-shaped engageable-disengageable members 60 and 62. Also, it is not necessary that these engageable-disengageable members be L-shaped. A number of known engagements or interlocks can be used instead, such as pins in holes, etc.

Pocket For Memory Chip 24

As shown in FIGS. 1 and 4–6, the housing halves 12 and 14 at bottom wall portions 48 and 50 have respective pocket portions 70 and 72 which include slightly smaller and larger wall opening portions 74 and 76 and sleeve or channel portions 78 and 80. Moreover, the bottom wall portion 48 at an inner side 82 and the bottom wall portion 50 at the inner side 64 have respective ink blocking shield segments 84 and 86 that project inwardly of the housing halves 12 and 14 from the inner sides. See FIGS. 5 and 6. The ink blocking shield segment 84 is an integral extension of the inner side 82 and extends across the wall opening portion 74, and the ink blocking shield segment 86 is an integral extension of the inner side 64 and extends across the wall opening portion 76. This is to isolate or seal the wall opening portions 74 and 76 from the interiors of the housing halves 12 and 14.

When the housing halves 12 and 14 are connected together, the memory chip 24 is peripheral-edge supported in the channel portions 78 and 80 to hold the memory chip in the wall opening portions 74 and 76. Also, the pocket portions 70 and 72 combine to form a single pocket including the wall opening portions 74 and 76 combining to form a single wall opening, and the ink blocking shield segments 84 and 86 abut end-to-end to seal the single wall opening. The ink supply bag 16, which is between the housing halves 12 and 14, might per chance leak ink. However, the ink blocking shield segments 84 and 86 which are then abutted end-to-end prevent any ink from entering the wall opening portions 74 and 76 and contaminating the memory chip 24.

Stakes For Fitting 18

Figure 7:
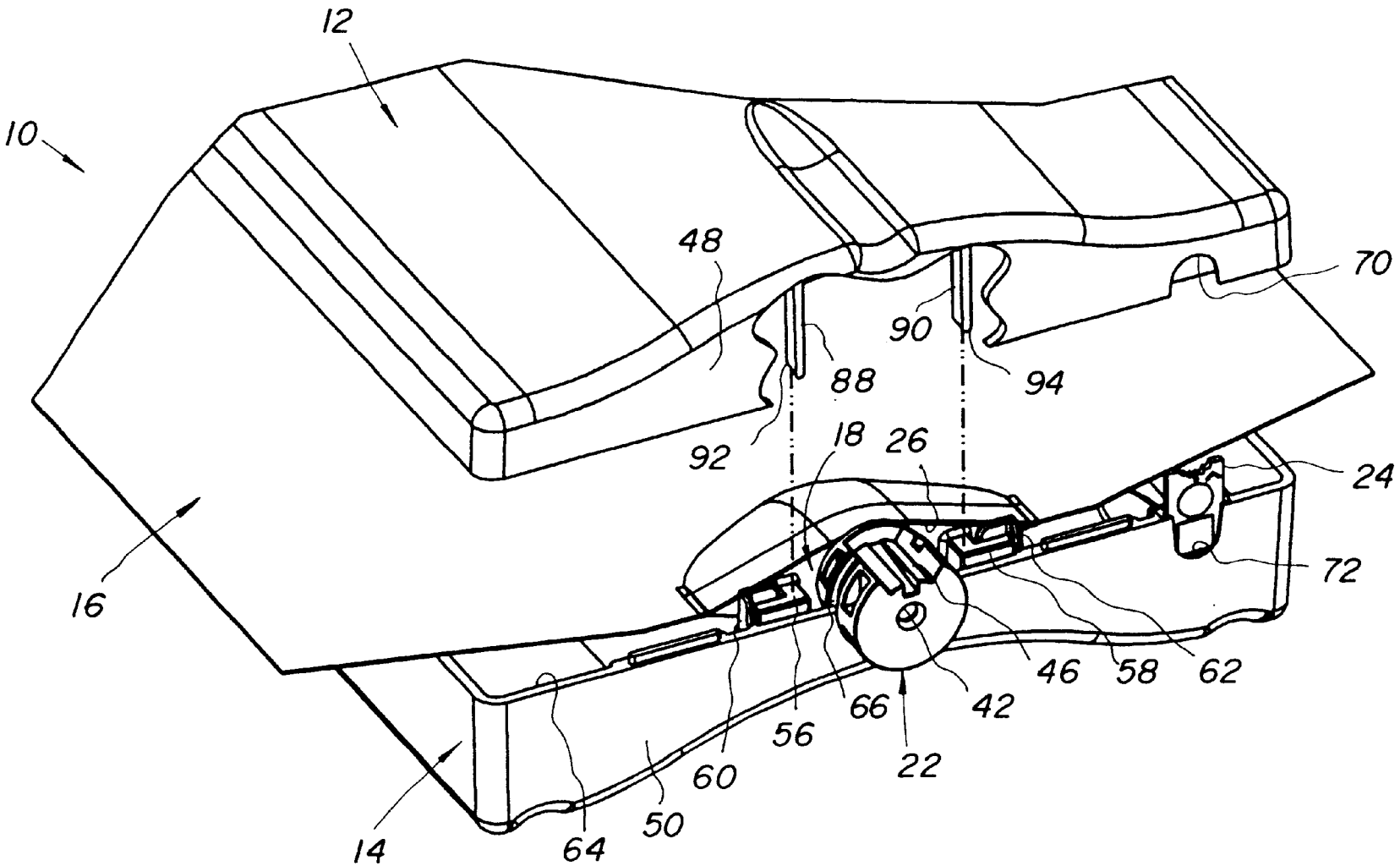
FIG. 7 is a view similar to FIG. 4, showing the housing cut away to reveal stakes that are adhered to the fitting.

As shown in FIG. 7, the housing half 12 has at least two interior stakes 88 and 90 that project from the housing half and are parallel to the bottom wall portion 48 of the housing half. When the housing halves 12 and 14 connected together, respective tips 92 and 94 of the stakes 88 and 90 are melted preferably onto the L-shaped engageable-disengageable members 56 and 58 of the fitting 18 to adhere the stakes to those L-shaped members. The stakes 88 and 90 thus hold the L-shaped engageable-disengageable members 56 and 58 of the fitting 18 fast to the housing half 12, and can be separated from those L-shaped members only by breaking the connection at the melted tips 92 and 94 (or by breaking the stakes and/or the L-shaped members). This positively ensures that the fitting 18 cannot shift, however slightly, when the L-shaped engageable-disengageable member 56 is engaged with the L-shaped engageable-disengageable member 60 and the L-shaped engageable-disengageable member 58 is engaged with the L-shaped engageable-disengageable member 62 as shown in FIGS. 4 and 7. Also, the fitting 18 cannot be removed from the housing half 12 without forcibly separating the stakes 88 and 90 from the L-shaped engageable-disengageable members 56 and 58.

Alternatively, the tips 92 and 94 of the stakes 88 and 90 can be melted onto the L-shaped engageable members 60 and 62 of the housing half 14 to hold those L-shaped members fast to the housing half 12.

Alternatively, the tips 92 and 94 of the stakes 88 and 90 can be melted onto both the L-shaped engageable members 56 and 58 of the fitting 18 and the L-shaped engageable members 60 and 62 of the housing half 14.

The tips 92 and 94 of the stakes 88 and 90 can be melted onto the L-shaped engageable members 56 and 58 of the fitting 18 and/or the L-shaped engageable members 60 and 62 of the housing half 14 via a conventional vibration weld that melts the tips.

The invention has been described in detail with particular reference to certain preferred embodiments thereof, but it will be understood that variations and modifications can be effected within the spirit and scope of the invention. For example, the tips 92 and 94 of the stakes 88 and 90 need not be melted onto the L-shaped engageable-disengageable members 56 and 58 of the fitting 18 and/or the L-shaped engageable members 60 and 62 of the housing half 14. Instead, the tips 92 and 94 of the stakes 88 and 90 might substantially contact the L-shaped engageable-disengageable members 56 and 58 of the fitting 18 and/or the L-shaped engageable members 60 and 62 of the housing half 14.

Parts List

10. ink cartridge
12. housing half
14. housing half
16. ink bag
18. connector-fitting
20. snout
22. collar
24. memory chip
26. elongate opening
28. ribs
30. septum
32. ink egress opening
34. cap
36. center opening
38. eight surfaces or facets
40. face
42. center opening
44. eight surfaces or facets
46. key slot
48. bottom wall portion
50. bottom wall portion
52. opening half
54. opening half
56. L-shaped engageable member
58. L-shaped engageable member
60. L-shaped engageable member
62. L-shaped engageable member
64. inner side
65. edge
66. groove
68. edge
70. pocket portion
72. pocket portion
74. wall opening portion
76. wall opening portion
78. sleeve or channel portion
80. sleeve or channel portion
82. inner side
84. ink blocking shield segment
86. ink blocking shield segment
88. stake
90. stake
92. tip
94. tip

What is claimed is:

1. An ink cartridge comprising an ink supply bag, a housing for said bag, and a fitting attached to said bag and including an ink egress snout for discharging an ink supply from said bag, is characterized in that:

said housing and said fitting are connected to secure said bag within said housing, but can be disconnected; and said housing has stakes that are adhered to respective portions of said fitting to hold said fitting fast to said housing in order to fix said fitting in place and prevent said fitting from shifting, however slightly, or being disconnected from said housing.

2. An ink cartridge as recited in claim 1, wherein a collar mates with said snout when said collar is in a selected orientation to fix said collar in the selected orientation in order to provide an identification of an ink supply in said bag.

3. An ink cartridge as recited in claim 1, wherein said housing and said fitting each have engageable-disenageable members that mutually engage to connect said housing and said fitting, and said stakes are adhered to said engageable-disengageable members of said fitting to hold those engageable-disengageable members fast to said housing in order to prevent said fitting from being disconnected from said housing without breaking said stakes and/or said engageable-disengageable members.

4. An ink cartridge as recited in claim 3, wherein said stakes have respective tips that are melted onto said engageable-disengageable members of said fitting to adhere said stakes to those engageable-disengageable members.

5. An ink cartridge as recited in claim 3, wherein said housing includes a wall with an opening for said snout, said engageable-disengageable members of said housing are at an inner side of said wall and spaced from said opening for said snout, and said stakes are parallel to said inner side of said wall.

6. An ink cartridge comprising an ink supply bag, a fitting attached to said bag and including an ink egress snout, and a housing for said bag including a wall with an opening for said snout, is characterized in that:

said wall of said housing and said fitting have mutually engageable members that engage to connect said housing and said fitting; and said housing has stakes with respective tips that are melted onto said engageable members of said fitting to adhere said stakes to those engageable members.

7. An ink cartridge as recited in claim 6, wherein said engageable members of said housing are at an inner side of said wall and spaced from said opening for said snout, and said stakes project from said housing and parallel to said inner side of said wall.

8. An ink cartridge as recited in claim 6, wherein a collar mates with said snout when said collar is in a selected orientation to fix said collar in that orientation in order to provide an identification of an ink supply in said bag.

9. An ink cartridge comprising an ink supply bag, a fitting attached to said bag and including an integral ink egress snout, and a pair of housing halves that contain said bag and at respective wall portions have opening halves that form a bottom opening for said snout when said housing halves are connected together, is characterized in that:

said fitting and only one of said wall portions each have mutually engageable members that engage to connect said fitting and the one wall portion; and the housing half that includes another of said wall portions has stakes that are adhered to said engageable members of said fitting to hold said engageable members of said fitting fast to that housing half.

10. An ink cartridge as recited in claim 9, wherein said engageable members of said one wall portion are spaced from said opening half in that wall portion and said engageable members of said fitting are spaced from said snout.

11. An ink cartridge comprising an ink supply bag, a fitting attached to said bag and including an integral ink egress snout, and a pair of housing halves that contain said bag and at respective wall portions have opening halves that form a bottom opening for said snout when said housing halves are connected together, is characterized in that:

said fitting and only one of said wall portions each have mutually engageable members that engage to connect said fitting and the one wall portion to secure said bag within the housing half that includes said one wall portion; and the housing half that includes another of said wall portions has stakes that are adhered to said engageable members of said fitting and/or said engageable members of the housing half that includes said one wall portion.

12. A method of partially assembling a ink cartridge including an ink supply bag, a housing that is to contain the bag, and a fitting for the bag which has an ink egress snout for discharging an ink supply from the bag, said method comprising:

attaching the fitting to the bag;

connecting the housing and the fitting to one another; and adhering to the fitting a plurality of stakes that project from the housing to hold the fitting fast to the housing in order to fix the fitting in place and prevent the fitting from shifting, however slightly, relative to the housing.

13. A method of partially assembling an ink cartridge including an ink supply bag, a fitting for the bag which has an integral ink egress snout, and a pair of housing halves that are to contain the bag and at respective wall portions have opening halves that form a bottom opening for the snout when the housing halves are connected together, said method comprising:

attaching the fitting to the bag;

connecting mutually engageable members of the fitting and only one of the wall portions to secure the bag to the housing half that includes the one wall portion; and adhering to the engageable members of the fitting and/or the engageable members of the one wall portion a plurality of stakes that project from the housing half that includes another of the wall portions.

14. A method as recited in claim 13, wherein the stakes are adhered to the engageable members of the fitting and/or the engageable members of the one wall portion by melting respective tips of the stakes onto those engageable members.

* * * * *